US005980342A

United States Patent [19]

Logan et al.

[11] Patent Number: 5,980,342

[45] Date of Patent: Nov. 9, 1999

[54] FLUSHING SYSTEM FOR A MARINE PROPULSION ENGINE

[75] Inventors: Andrew K. Logan; Matthew W. Jaeger; James E. Sharp; Lawrence C. Bibow, all of Stillwater; William E. Hughes, Perry, all of Okla.

[73] Assignee: Brunswick Corporation, Lake Forest, Ill.

[21] Appl. No.: 09/165,144

[22] Filed: Oct. 1, 1998

[51] Int. Cl.[6] ..... B63H 21/10

[52] U.S. Cl. ..... 440/88; 134/169 A

[58] Field of Search ..... 440/88, 113, 900; 134/167 R, 169 A

[56] References Cited

U.S. PATENT DOCUMENTS

| | | | |
|---|---|---|---|
| 4,065,325 | 12/1977 | Maloney | 134/167 |
| 4,246,863 | 1/1981 | Reese | 440/88 |
| 4,359,063 | 11/1982 | Carlson | 134/167 |
| 4,540,009 | 9/1985 | Karls | 134/167 |
| 4,589,851 | 5/1986 | Karls | 440/88 |
| 4,869,695 | 9/1989 | Sajdak, Jr. | 440/88 |
| 5,051,104 | 9/1991 | Guhlin | 440/88 |
| 5,071,377 | 12/1991 | Saunders et al. | 440/88 |
| 5,362,265 | 11/1994 | Gervais | 440/88 |
| 5,362,266 | 11/1994 | Brogdon | 440/88 |
| 5,393,252 | 2/1995 | Brogdon | 440/88 |
| 5,397,256 | 3/1995 | Bidwell | 440/88 |
| 5,423,703 | 6/1995 | Lorenzen | 440/88 |
| 5,441,431 | 8/1995 | Brogdon | 440/88 |
| 5,482,483 | 1/1996 | Rice | 440/88 |
| 5,628,285 | 5/1997 | Logan et al. | 123/41.14 |
| 5,671,906 | 9/1997 | Rosen | 251/148 |
| 5,679,038 | 10/1997 | Neisen et al. | 440/88 |
| 5,725,403 | 3/1998 | Ridolfo | 440/88 |

*Primary Examiner*—Jesus D. Sotelo
*Attorney, Agent, or Firm*—William D. Lanyi

[57] ABSTRACT

A flushing system provides a pair of check valves that are used in combination with each other. One of the check valve is attached to a hose located between the circulating pump and the thermostat housing of the engine. The other check valve is attached to a hose through which fresh water is provided. Both check valves prevent flow of water through them unless they are associated together in locking attachment. The check valve attached to the circulating pump hose of the engine directs a stream of water from the hose toward the circulating pump so that the water can then flow through the circulating pump, the engine block, the heads, the intake manifold, and the exhaust system of the engine to remove seawater residue from the internal passages and surfaces of the engine. It is not required that the engine be operated during the flushing operation.

15 Claims, 8 Drawing Sheets

FLUSHING SYSTEM FOR A MARINE PROPULSION ENGINE

BACKGROUND OF THE INVENTION

1. Field of the Invention

The present invention is generally related to a flushing system for a marine propulsion engine and, more particularly, to a flushing system that effectively removes seawater residue from the internal passages and surfaces of a marine engine.

2. Description of the Prior Art

As is well known to those who operate marine vessels, it is typical for a marine engine which is used offshore to draw seawater into its internal cavities for use as cooling water. Although some marine engines may use a closed loop cooling water system, many do not. Instead, a seawater pump is used to draw seawater upward through the marine drive unit and then through the internal cavities of the engine.

Seawater is inherently undesirable because of its corrosive effect on the internal passages of the engine. After seawater flows through an engine, the mineral and biological residue is extremely corrosive to cast iron components. Although most skilled operators realize that it is beneficial to periodically flush marine engines used in seawater, it is difficult and time consuming to do so. As a result, many marine engines do not receive appropriate maintenance and cleaning in a timely manner.

Many different types of flushing systems have been developed for both stern drive propulsion units and outboard motors. U.S. Pat. No. 4,869,695, which issued to Sajdak on Sep. 26, 1989, discloses a storage boot and method for flushing outboard motors. The flexible cylindrical boot is provided with a plastic reinforced opening containing multiple nylon rivets for connection to one or more nylon cords. The boot is mounted around the shaft of a small outboard motor. A telescopic handle is attached to the reinforced opening and it guides the boot around the motor shaft after a garden hose is attached to a connector which is integral with a bottom of the boot. Fresh water from a faucet fills the boot and the motor is run at an idle speed to permit seawater flushing of the coolant system. The brackish water is then siphoned from the boot for dry storage of the motor in an upright position attached to the transom of a boat.

U.S. Pat. No. 5,725,403, which issued to Ridolfo on Mar. 10, 1998, describes a marine outboard motor flush and run tank and a method of flushing a marine outboard motor. The method of flushing the outboard motor uses a marine outboard motor flush and run tank wherein the marine outboard motor flush and run tank comprises a flush trough member, a fluid inlet, and a fluid outlet. The method of flushing an outboard marine motor flushes from the coolant system of an outboard marine motor salt, silt, and other material. An organic detergent is added to fresh water to form a mixture which is siphoned into the coolant system for breaking down and purging the salt, silt, and other material from the coolant system.

U.S. Pat. No. 5,679,038, which issued to Neisen et al on Oct. 21, 1997, discloses a pulsating flushing device. The device is used for a cooling system of a marine drive which includes a housing having an inlet for receiving pressurized flushing coolant, an outlet for discharging the flushing coolant to the marine drive cooling system, a pulsating chamber between the inlet and outlet, and a pulsation mechanism in the pulsation chamber and receiving the pressurized flushing coolant and imparting a pulsation movement thereto and delivering pulsating flushing coolant to the outlet.

U.S. Pat. No. 4,589,851, which issued to Karls on May 20, 1986, discloses a flushing device for an outboard motor. The device is provided to supply water to an inlet provided on the bottom of the anti-ventilation plate of an outboard motor. The flushing device uses a mounting bracket to hold a resilient cup compressed in place over the water inlet. A hose connector allows the cup to be connected to a water supply.

U.S. Pat. No. 4,540,009, which issued to Karls on Sep. 10, 1985, describes a flushing device for an outboard motor. The device is used for supplying water to the cooling water inlets of an outboard motor and uses a connecting pin extending through the inlets to attach a pair of sealing cups over the inlets. A sliding spring latch releasable attaches one of the cups to the connecting pin. A hose connection allows water to be supplied to the inlets through the cup.

U.S. Pat. No. 5,628,285, which issued to Logan et al on May 13, 1997, describes a drain valve for a marine engine. The drain valve assembly automatically drains water from a cooling system of an inboard marine engine when the ambient temperature drops to a preselected value. The drain valve includes a cup-shaped base having a group of inlets connected to portions of a cooling system of the engine to be drained, and the open end of the base is enclosed by a cover. Each inlet defines a valve seat. A sealing piston is mounted for movement in the base and includes a series of valve members that are adapted to engage the valve seats. An outlet is provided in the sidewall of the base. The valve members on the sealing piston are biased to a closed position by a coil spring and a temperature responsive element interconnects the sealing piston with the cover. The temperature responsive element is characterized by the ability to exert a force in excess of the spring force of the coil spring when the ambient temperature is above 50° F., in order to thereby maintain the valve members in the closed position. When the temperature falls below the preselected temperature, the temperature responsive element will retract, and permit the valve members to be opened under the influence of the spring to automatically drain water from the cooling system of the engine.

U.S. Pat. No. 4,065,325, which issued to Maloney on Dec. 27, 1977, describes a flush attachment for marine engines having side cooling water ports. This device represents a universally adapted apparatus for use in flushing outboard and inboard/outboard marine engines. The universality is possible due to the unique design of a strap and the shape of the cups which allow for the device to attach flush against the motor shaft housing on motors having shaft housings of different dimensions and contours.

U.S. Pat. No. 4,359,063, which issued to Carlson on Nov. 16, 1982, describes a spring-biased flushing accessory for outboard motors. A self-gripping spring-biased accessory is provided for directing water from an outside source to flush out the cooling system of a marine engine. The accessory comprises a U-shape retaining terminating at its upper ends in a pair of resilient suction cups which are constructed to bear against cooling water intake ports on opposite walls of the engine housing. At least one of the cups is connected to an external source of flushing water. A particular feature of the invention, disclosed in several different embodiments of the invention, is that the U-shaped retainer is provided with an auxiliary device to impart spring-bias to the legs, urging them to move towards one another to secure the suction cups in resilient sealed relation against the cooling water intake ports. In a further modification, a device is provided to apply the flushing water simultaneously to intake ports on opposite side walls of the engine housing.

U.S. Pat. No. 5,482,483, which issued to Rice on Jan. 9, 1996, describes a portable marine engine flushing system. The flushing device is used for a marine engine. It comprises a reservoir for temporary water storage and a delivery system to the marine engine. The power source for the system is gravity, which allows it be portable.

U.S. Pat. No. 5,671,906, which issued to Rosen on Sep. 30, 1997, describes a flush valve for a water cooled marine outboard engine having a flush orifice. The flush valve includes a valve body with an engine attachment end and a flush water source end. The valve body has a channel between the engine end and the source end. The engine end of the valve body can be affixed into the flush orifice of the engine. The flush valve also includes a means for obstructing a discharge flow of cooling liquid from the engine end of the hollow valve body.

U.S. Pat. No. 5,362,266, which issued to Brogdon on Nov. 8, 1994, describes a flush master fresh water flushing system. The system is used for a marine engine in a boat and is operable whether the boat is in or out of the water. The system comprises a control panel mounted on the interior of the boat, a plurality of tubular cut "T" shaped interconnection fittings in a raw seawater cooling conduit, and a fresh water flush valve therebetween. The components are connected for fresh water fluid flow with a plurality of standard radiator hoses. The fresh water flush valve has a valve plunger for establishing fresh flow between the control panel and the "T" shaped interconnection fittings. Further, the fresh water flush valve has a plurality of axial outlet ports to proportionately direct the flow of fresh water to the appropriate "T" shaped interconnection fitting in the raw seawater cooling conduit of the marine engine. A valve plug is provided to secure a positive closure when the fresh water flow is disconnected. The valve plug has a tapered body and an O-ring to effect a positive seal and insure that no fluid backflow occurs when the flushing system is not in use and operation of the marine engine is operating under normal conditions in seawater. All of the fixed and movable parts are fabricated from material that resists salt air and seawater corrosion.

U.S. Pat. No. 5,441,431, which issued to Brogdon on Aug. 15, 1995, describes a fresh water flushing system for a marine engine in a boat. The system is used whether or not the boat is in water. The system comprises a control panel mounted on the interior of the boat, a plurality of tubular T-shaped interconnection fittings in a raw seawater cooling conduit, and a fresh water flush valve. The components are connected for fresh water fluid flow. The fresh water flush valve has a valve plunger for establishing fresh water flow between the control panel and the T-shaped interconnection fittings.

U.S. Pat. No. 5,393,252, which issued to Brogdon on Feb. 28, 1995, discloses a fresh water flushing system. The system comprises a control panel mounted in the proximity of the marine engine and a fresh water flush valve. Hoses are connected to the fresh water flush valve and to various components of the marine engine system to provide for fresh water fluid flow within the engine. Alternative embodiments are included for marine vessels with one or more engines.

U.S. Pat. No. 5,071,377, which issued to Saunders et al on Dec. 10, 1991, describes an inboard marine engine flushing device. The device includes a flexible, resiliently deformable preferably elastomeric conical shaped hollow member having a smaller inlet and a larger outlet. The outlet includes a water sealing surface which is sized to sealably engaged around an engine seawater inlet fitting fixed to a boat hull. A preferably T-shaped hollow water supply conduit is also included which has a first leg connected to the inlet end, a second leg connected to a pressurized water supply, and a third leg which is plugged or is otherwise sealably engaged into a telescopically extendable and lockable elongated ground engaging member. The ground engaging member lockably retains the water sealing surface forcibly urged against the boat hull during the flushing operation. The conical member is also bendably resilient to accommodate hull surfaces which are at a substantial angle to horizontal in the vicinity of the seawater inlet fitting.

U.S. Pat. No. 4,246,863, which issued to Reese on Jan. 27, 1981, discloses a flushing assembly of the type used to clean outboard motors by forcing cleaning water through the inlet ports of the outboard motor. It comprises a base that is specifically structured to provide a water inlet in fluid communicating relation to the inlet ports of the motor. The base is structured so as to be capable of being clamped to the motor being cleaned adjacent the inlet ports and further to allow a water supply to be interconnected to the base wherein both the water supply and the adjustment of the base occurs at a location remote from the motor being cleaned so as to facilitate such cleaning when the motor is not readily accessible.

U.S. Pat. No. 5,362,265, which issued to Gervais on Nov. 8, 1994, describes a marine engine flushing apparatus and method. The apparatus employs a conduit coupled to a fluid supply for supplying fluid to the marine engine. A valve assembly is mounted to the conduit between the fluid supply and the cooling inlet port and controls the flow of fluid to the cooling inlet port. The valve assembly is responsive to a start signal to permit the flow of fluid and a switch assembly is electrically coupled to the valve assembly and to the marine engine for providing the start signal to the valve assembly to allow the fluid to flow and an engine signal to the marine engine to enable starting of the engine.

U.S. Pat. No. 5,397,256, which issued to Bidwell on Mar. 14, 1995, describes a flushing apparatus for a boat motor. It employs clamping members that operate hydraulically to engage the opposite sides of the engine housing. They are positioned over water intake ports of the motor. Upon full engagement of the apparatus, a check-valve opens to permit water to flow through a clamping member and into the housing.

U.S. Pat. No. 5,051,104, which issued to Guhlin on Sep. 24, 1991, discloses a flushing device for a motor boat engine. The device is used for flushing the cooling systems of water cooled outboard and inboard/outboard motorboat engines that draw cooling water through intakes in the engine housing beneath the surface of the water in which the boat is operating. The apparatus allows lubricant to be injected into the cooling system after the cooling system has been flushed with clean, fresh water to leave a coating of oil in the surfaces of the cooling system to prevent rust from forming on the surface. The apparatus consists of a U-shaped spring with two legs on which are slidably mounted two cup-shaped seal members constructed of elastomeric material. The seal members are positioned over the cooling intakes of the engine housing. One of the seal members has an opening through which clean fresh water is introduced and the other sealing member has an opening through which lubricant is introduced.

U.S. Pat. No. 5,423,703, which issued to Lorenzen on Jun. 13, 1995, describes an outboard motor flushing system. The apparatus is used for flushing a marine engine outboard propulsion unit and includes a pair of sealing elements for covering the cooling water inlets of a marine engine propulsion unit. A U-shaped sealing element retainer is provided with a pair of arms and has one of the sealing elements attached to each arm. An elongated hollow rigid pipe has a handle on one end and a metal rod on the other end. The metal rod has an attaching clamp for removably attaching the metal rod and hollow rigid pipe to the U-shaped retainer. The hollow rigid pipe has a water coupling on each end thereof and one of the couplings has a flexible tube attached thereto into one of the sealing elements for conveying water from the hollow tube to the sealing element and the cooling water inlets of an outboard motor. The coupling at the other end of the hollow rigid pipe is attached to a water hose. The handle end of the rigid pipe has a water control valve on the handle for controlling the flow of water and both the handle end and the metal rod end are removably attached to a pipe so that the pipe can be interchanged for different lengths.

As owners and operators of marine vessels know, it is beneficial to drain cooling water from an engine at certain times and to flush the internal compartments of the engine with fresh water at certain times. For example, it is necessary to drain residual water from an engine if it is expected that temperatures will fall below freezing levels. This draining is performed to avoid damage to the engine block and other engine components by freezing water, which expands. It is also advisable to periodically flush the internal passages of an engine that is used in seawater. Otherwise, residual minerals can adhere to the internal passages and surfaces of the engine and cause corrosion. Flushing is particularly helpful if the engine is used in saltwater or corrosive applications.

Any draining or flushing system should exhibit certain characteristics in order to be useful for these purposes. The system should be easy to use. This includes being convenient to activate and deactivate. In addition, a flushing system should be relatively inexpensive. Otherwise, many operators would opt to do without an expensive system and, as a result, long term damage to the engine may occur. It is also very important that a flushing system be effective. Many known types of flushing systems are known to those skilled in the art, but known systems are not always effective in achieving a total flushing of the internal passages of the engine. It is therefore very important to introduce the fresh water at the proper location of the engine and assure that it effectively flows through the passages in all of the critical regions of the engine. It would therefore be significantly beneficial if a means could be provided that is both simple and inexpensive, but highly effective in flushing the internal compartment of an internal combustion engine used in marine applications.

SUMMARY OF THE INVENTION

An engine flushing system made in accordance with the present invention comprises a conduit that is connected in fluid communication with a circulating pump of the engine. In addition, a first check valve is connected in fluid communication with the conduit, with the first check valve being configured to prevent water from flowing through the first check valve unless the first check valve is first opened by an external means. The check valve can be of the type that is very well known to those skilled in the art and is connectable in fluid communication with an external water supply, such as a fresh water faucet.

In a particularly preferred embodiment of the present invention, it further comprises a second check valve attached to a hose of the external fresh water supply. The first and second check valve are shaped to receive each other in locking attachment. The locking attachment permits water flow through the first and second check valves by actuating moveable components which open water paths through both check valves.

The second check valve is configured to prevent water from flowing from the external water supply through the hose unless the second check valve is opened by a second external means. In a preferred embodiment of the present invention, the second external means needed to open the second check valve is the first check valve. In other words, when the first check valve is attached to the second check valve, in locking attachment, it provides the necessary second external means to open the second check valve.

The flushing system of the present invention, in a particularly preferred embodiment, further comprises an elbow insert connected in fluid communication with the conduit, or circulating pump hose. The first check valve is attached to the elbow insert in order to permit water to flow through a wall of the elbow insert. The conduit can be the circulating hose that is connected between the circulating pump and the thermostat housing of the engine. In a particularly preferred embodiment of the present invention, the first check valve is aligned to cause water flowing through the first check valve to flow directly towards the circulating pump. The first check valve is shaped to fit into the second check valve in order to accomplish the locking attachment. In other words, in a preferred embodiment, the first check valve is provided with a male fitting and the second check valve is provided with a female fitting. However, reversal of these two fittings is also possible within alternative embodiments of the present invention.

BRIEF DESCRIPTION OF THE DRAWINGS

The present invention will be more fully and completely understood from a reading of the description of the preferred embodiment in conjunction with the drawings in which.

DESCRIPTION OF THE PREFERRED EMBODIMENT

Figure 1:
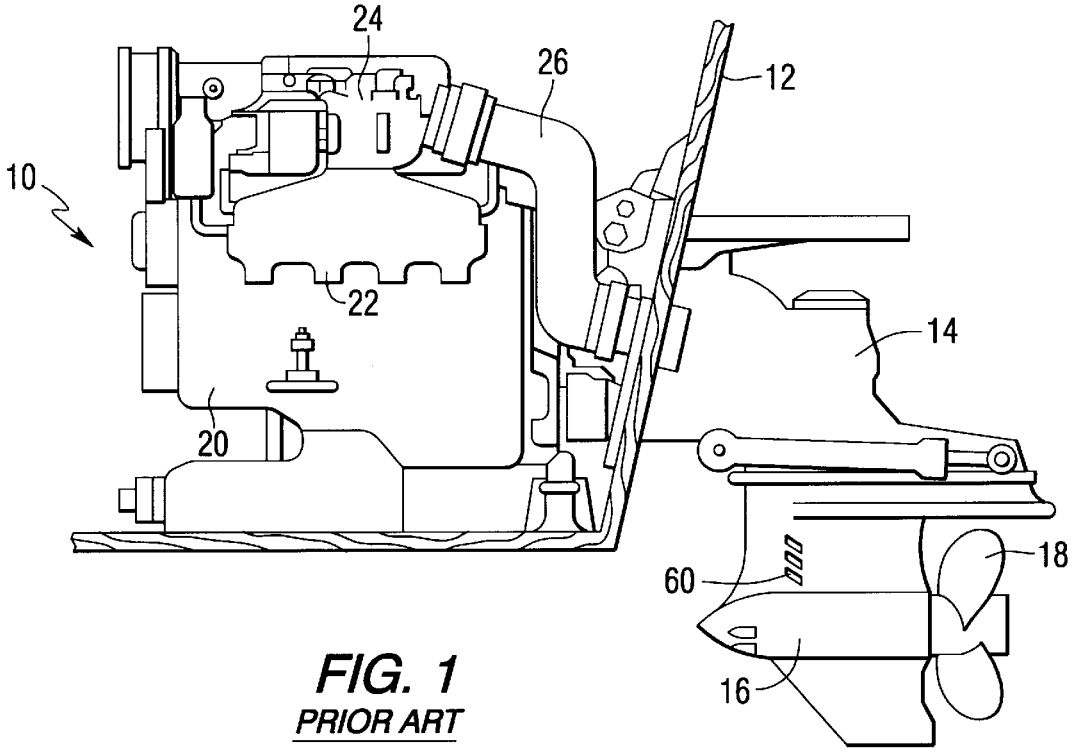
FIG. 1 PRIOR ART
FIG. 1 is a side section view of a known marine propulsion system, including a marine engine and a drive unit.

Throughout the description of the preferred embodiment of the present invention, like components will be identified by like reference numerals.

FIG. 1 is a section view of a known configuration of a marine propulsion system. An internal combustion engine 10 is provided with an outboard driveshaft (not visible in FIG. 1) that extends through the transom 12 of a marine vessel. A drive unit 14 extends through the transom 12 and into a body of water in which the marine vessel is operated. The drive unit 14 comprises a gear housing 16 which encloses a propeller shaft on which a propeller 18 is attached. The engine 10 comprises an engine block 20, one or more exhaust manifolds 22 and one or more exhaust elbows 24. The engine 10 also has a starboard exhaust manifold and exhaust elbow, 23 and 25 respectively, which are not visible in FIG. 1. In certain marine propulsion systems, the exhaust is directed from the cylinders, through the exhaust manifolds, 22 and 23, through the exhaust elbows, 24 and 25, through exhaust pipe 26 and through the drive unit 14 to exhaust along a center line of the propeller shaft and through a central hub of the propeller 18. The system shown in FIG. 1 is represented schematically to show a typical arrangement of a marine engine 10 and drive unit 14 along with certain portions of the engine and drive unit which will be referred to below in the description of the preferred embodiment of the present invention.

Figure 2:
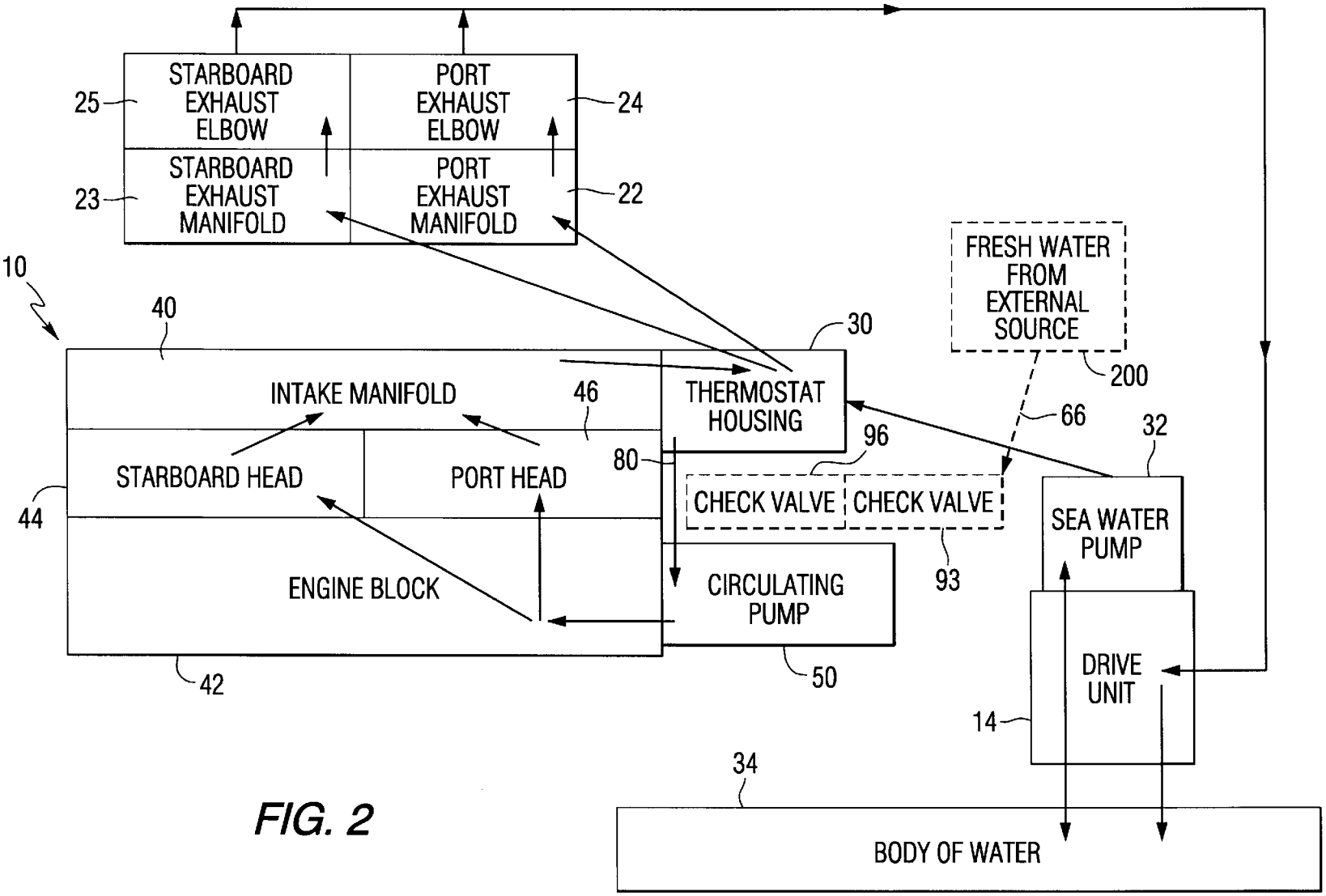
FIG. 2 is a schematic representation of the flow paths of water through a marine engine and drive unit.

FIG. 2 is a highly schematic representation of an open cooled marine propulsion system that will be used to describe the flow of water through the system during the normal operation of the engine and, subsequently, during the operation of the present invention. In the terminology familiar to those skilled in the art, an open cooled system uses lake or seawater for engine cooling while a closed cooling system uses a heat exchanger with an antifreeze liquid circulating through a closed loop. The antifreeze liquid, such as ethylene glycol, flows in thermal communication with an open loop of lake water or seawater. The present invention is particularly intended for use with an open cooling system.

When the engine 10 is running with a closed thermostat, water enters the thermostat housing 30 from the seawater pump 32 which draws the water from a body of water 34 in which the marine vessel is operated. The seawater is drawn upward from the body of water 34 through the drive unit 14, and through the seawater pump 32. Water will flow through the hose 80, into the circulating pump 50, into the engine block 42, through the heads, 44 and 46, and into the intake manifold 40. Then the water flows back to the circulating pump 50.

When the system shown in FIG. 2 becomes full of cooling water and the circulating pump 50 is moving that water, it will flow from the seawater pump 32 and then out to the exhaust manifolds 60 and 62 through a bypass passage in the thermostat housing 30. Water in the engine will enter the thermostat housing 30 from the intake manifold 40, leave the thermostat housing 30 via the circulation pump hose 80 and then pass through the circulating pump 50, where it again flows through the block 42, heads, 44 and 46, the intake manifold 40 and then back into the thermostat housing 30.

When the engine 10 is operating with an open thermostat, because the engine temperature exceeds a predetermined magnitude, the warm water passes to the thermostat housing 30 from the intake manifold 40. Instead of returning to the circulation pump 50, low pressure in the exhaust ports draws the water through the thermostat housing 30 and into the exhaust manifolds 60 and 62. Water from the seawater pump 32 flows into the hose 80 between the thermostat housing 30 and circulating pump 50 instead of out to the exhaust. The design of the thermostat housing 30 prevents the seawater from passing from the seawater pump 32 to the exhaust manifolds. In other words, it must pass through the circulating pump 50 first.

With continued reference to FIG. 2, the dashed boxes between the thermostat housing 30 and the circulating pump 50 represents the general location of the present invention which will be described in greater detail below.

Figure 3:
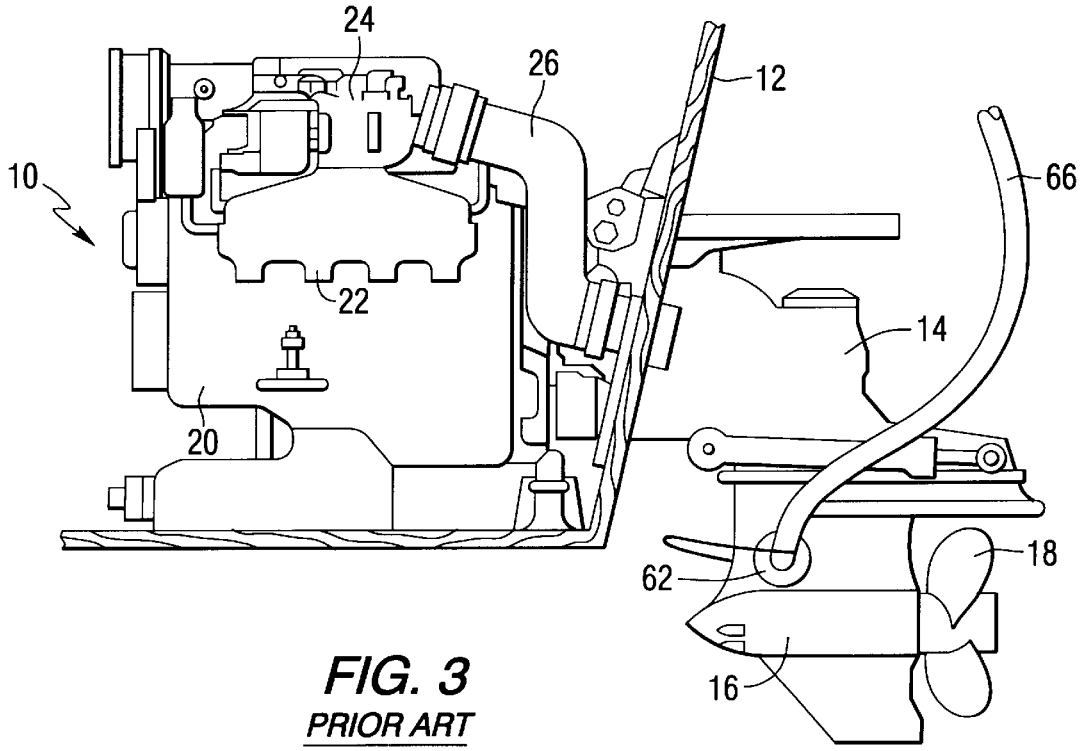
FIG. 3 PRIOR ART
FIG. 3 shows the propulsion unit of FIG. 1 with one known flushing system attached to it.

With reference to FIGS. 1 and 3, one known system for flushing marine propulsion systems is shown in FIG. 3. A portable flushing system comprises a pair of cups 62 which can be placed over the water inlet holes 60 of the drive unit. This allows a hose 66 to direct fresh water into the water inlet holes 60. The device is similar in operation to those shown in U.S. Pat. Nos. 4,359,069; 4,065,325; 4,540,009; and 4,589,851. The engine must be operated during this procedure in order to draw the water through the system. As discussed above in conjunction with FIG. 2, the water from the hose 66 also has to pass through the thermostat housing 30 and the other compartments of the engine cooling system after being forced upward from the cooling water inlets 60 through the drive unit 14.

Figure 4:
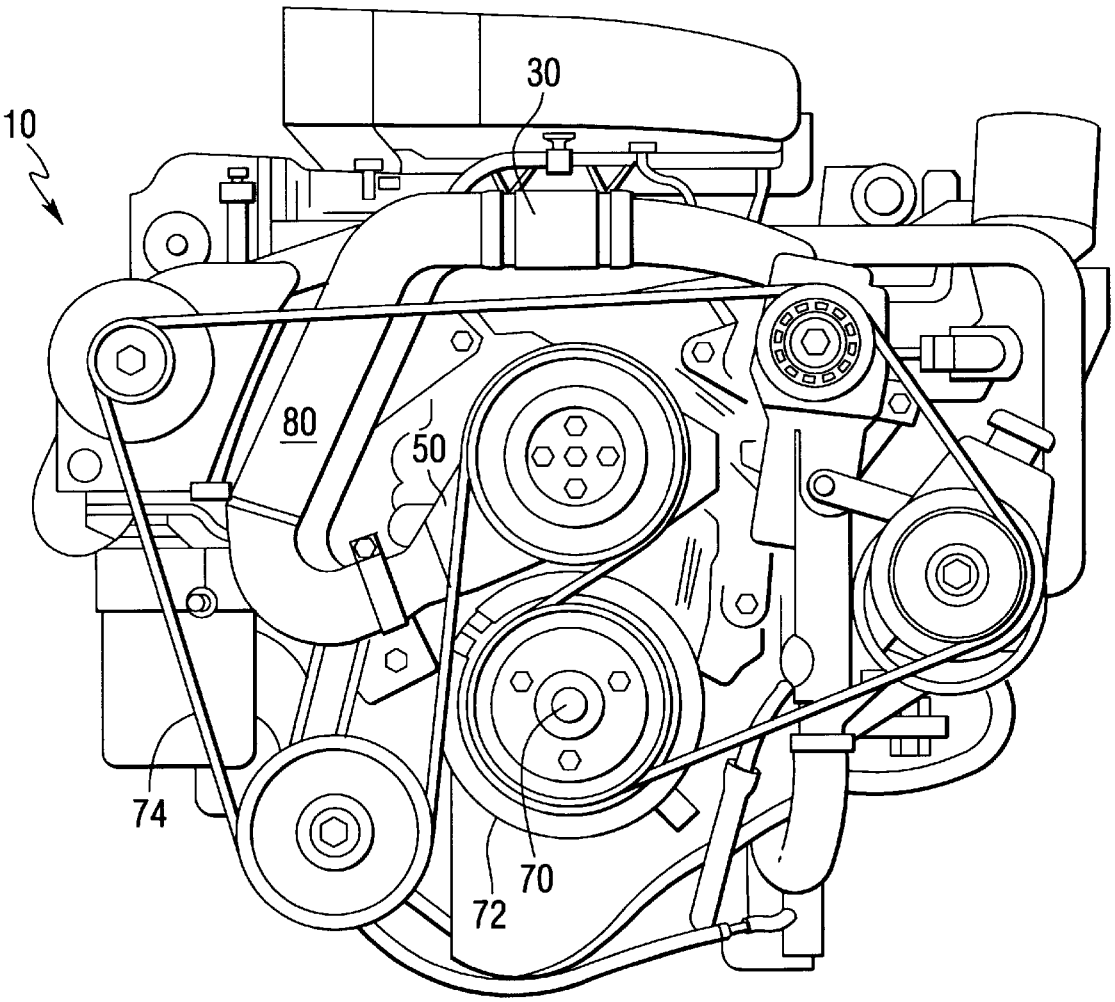
FIG. 4 PRIOR ART
FIG. 4 is a front view of a known marine engine.

FIG. 4 shows a front view of an engine 10 generally known to those skilled in the art. The engine has a crank shaft 70 that rotates a pulley 72 which causes a drive belt 74 to operate certain equipment supported by the engine 10. The drive belt 74 operates a circulating pump 50 which causes water to flow to a circulating pump hose 80 from the thermostat housing 30.

Figure 5:
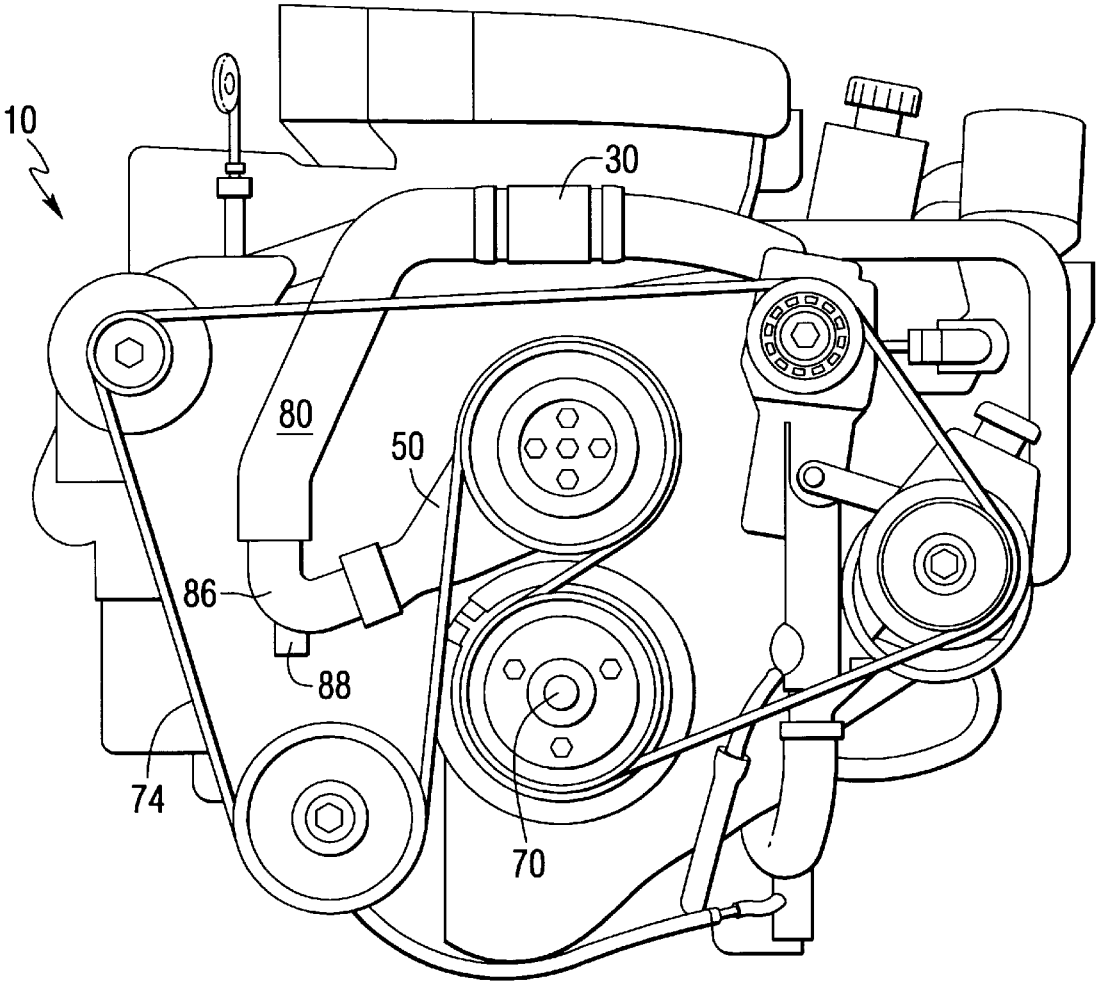
FIG. 5 PRIOR ART
FIG. 5 is a front view of the engine shown in FIG. 4, but with a known cast iron elbow inserted in a hose.
Figure 6:
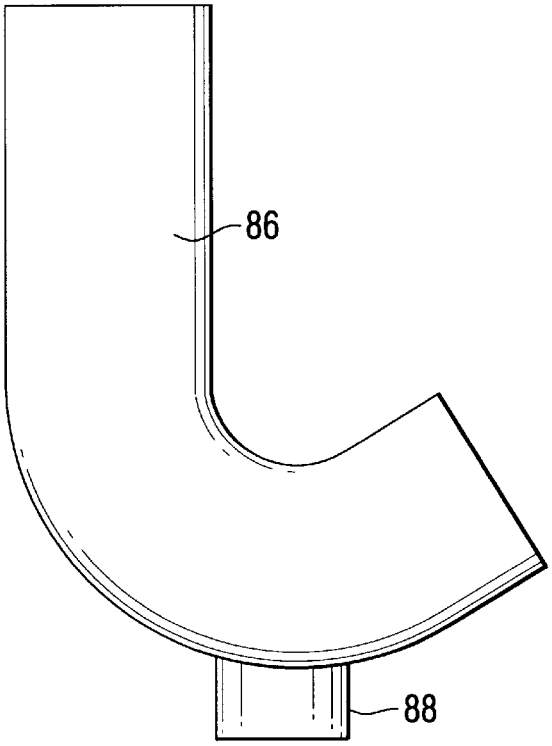
FIG. 6 PRIOR ART
FIG. 6 shows the cast iron elbow illustrated in FIG. 5.

FIG. 5 shows a known configuration of an engine 10 in which a cast iron elbow 86 is connected to the circulating pump hose 80. The arrangement shown in FIG. 5 has been used in the past to provide a means to drain water from a portion of the engine 10. The boss 88 on the elbow 86 can be drilled to provide a path through which water can drain from the circulating pump hose 80 and from the circulating pump itself into the bilge of the boat. A pipe plug can be used to block a tapped hole in the boss 88 when draining it is not desired. FIG. 6 shows the type of cast iron elbow 86 used to perform the function described above in conjunction with FIG. 5.

Figure 7:
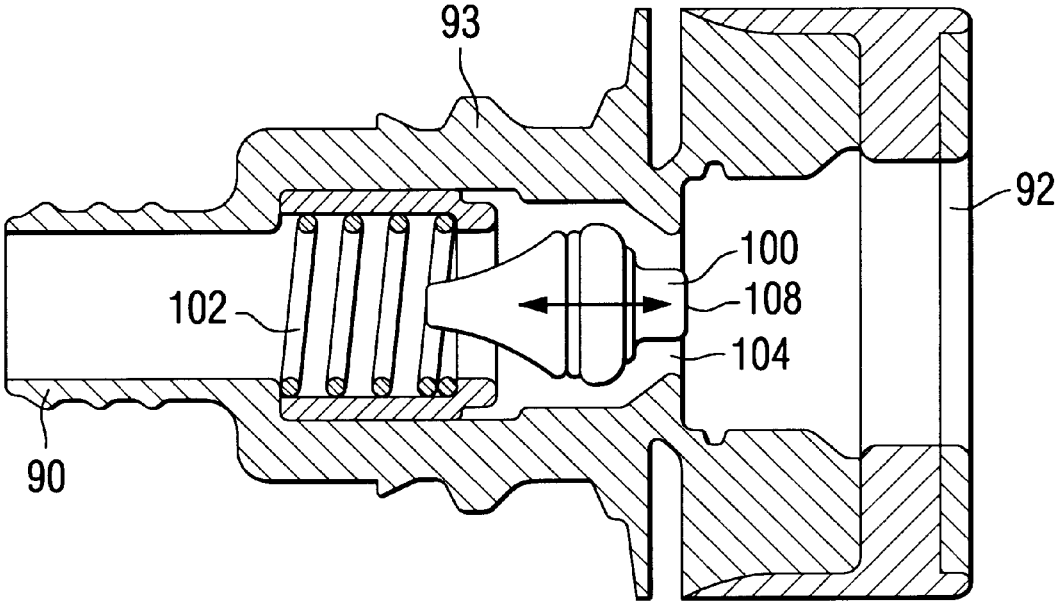
FIG. 7 PRIOR ART
FIGS. 7 and 8 show two known types of fluid connectors which can be used in one embodiment of the present invention.
Figure 8:
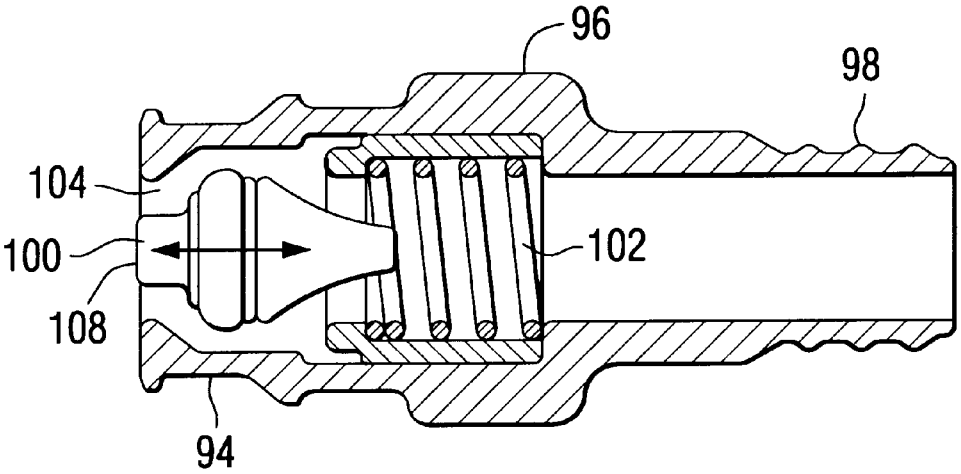
FIG. 8 PRIOR ART

FIGS. 7 and 8 show two components that are known to those skilled in the art and are available in commercial quantities from several sources. FIG. 7 shows a female connector 93 with one end 90 that is attachable to a bulkhead or a hose. The other end 92 is a female opening shaped to receive an end 94 of a male insert 96 shown in FIG. 8. The other end 98 of the male insert 96 is shaped to be received in a bulkhead, a generally rigid component, or a hose.

Although the components shown in FIGS. 7 and 8 are schematically represented, it can be seen that in both cases a moveable member 100 is moveable against the resistive force of a spring 102. If an external force moves the moveable member 100, against the resistance of the spring 102, the movement opens a fluid passage 104. One means to move the moveable member 100 against the force of the spring 102 is to provide a force against surface 108 of the moveable member. When end 94 of the male member 96 is inserted into opening 92 of the female member shown in FIG. 7, the surfaces 108 of the two moveable members 100 move into contact with each other and each provides the necessary force to move the other moveable member 100 against the force of the spring, to compress the spring, and to open the passage 104. When the two components shown in FIG. 7 and 8 are assembled together in locking attachment, the two surfaces 108 are in contact with each other and both springs 102 are compressed. As a result, both passages 104 are opened to allow fluid to pass through their respective members.

The components shown in FIGS. 7 and 8 are generally known to those skilled in the art and are available in commercial quantities in various forms. The advantage of the structures shown in FIGS. 7 and 8 is that when the two parts are uncoupled and are no longer in locked attachment with each other, the springs 102 cause the moveable members 100 to block the flow through passages 104. In this way, they both act as check valves. This prevents leakage through the two structures shown in FIGS. 7 and 8 unless they are firmly attached together in locked attachment.

Figure 9:
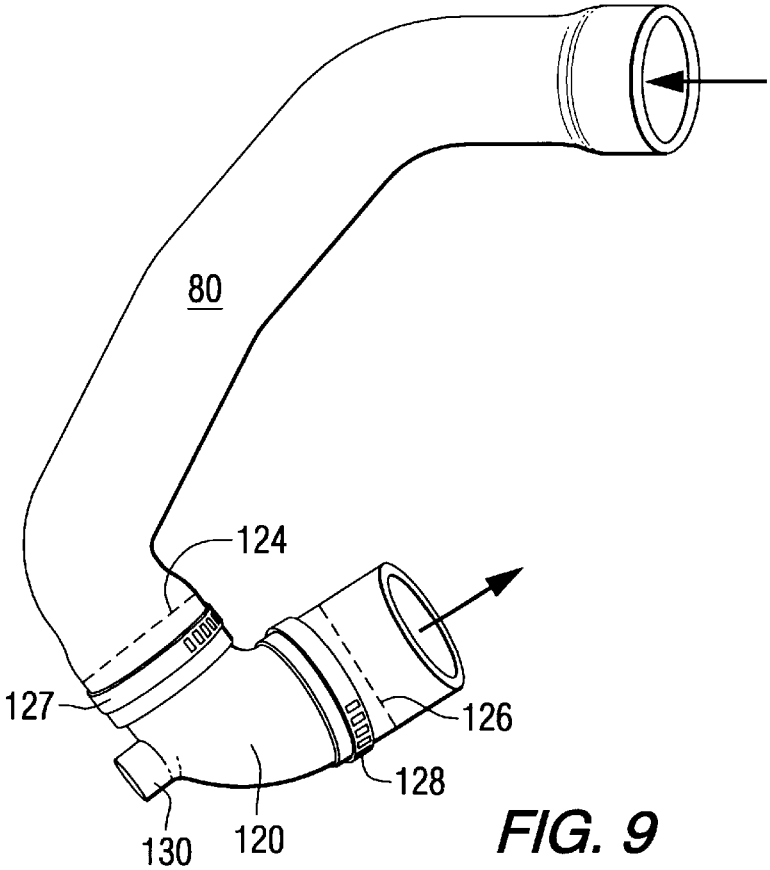
FIG. 9 shows an elbow insert associated with a hose of a marine engine.

FIG. 9 shows a circulating pump hose 80 with an elbow insert 120 connected in fluid communication with it. Water flowing through the circulating pump hose 80 in the direction represented by the arrows will pass through the elbow insert 120. Although not completely shown in FIG. 9, the elbow insert 120 is generally a 102° elbow that extends from dashed line 124 to dashed line 126 and is attached to the circulating pump hose 80 with hose clamps 127 and 128. It can also be formed as an integral part of the hose 80. The elbow insert 120 is provided with a boss extension 130 that is capable of receiving end 98 of the male connector 96 described above in conjunction with FIG. 8.

Figure 10:
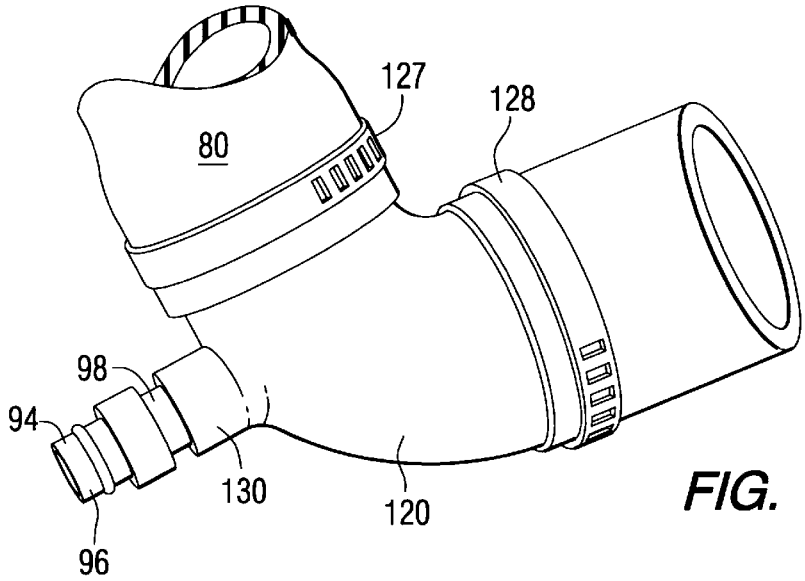
FIG. 10 shows the elbow insert of FIG. 9 associated with the connector of FIG. 8.

FIG. 10 is an enlarged view of the elbow insert 120, a portion of the circulating pump hose 80, and the other end 94 of the male insert 96 attached to the elbow insert 120 at the boss 130.

Figure 11:
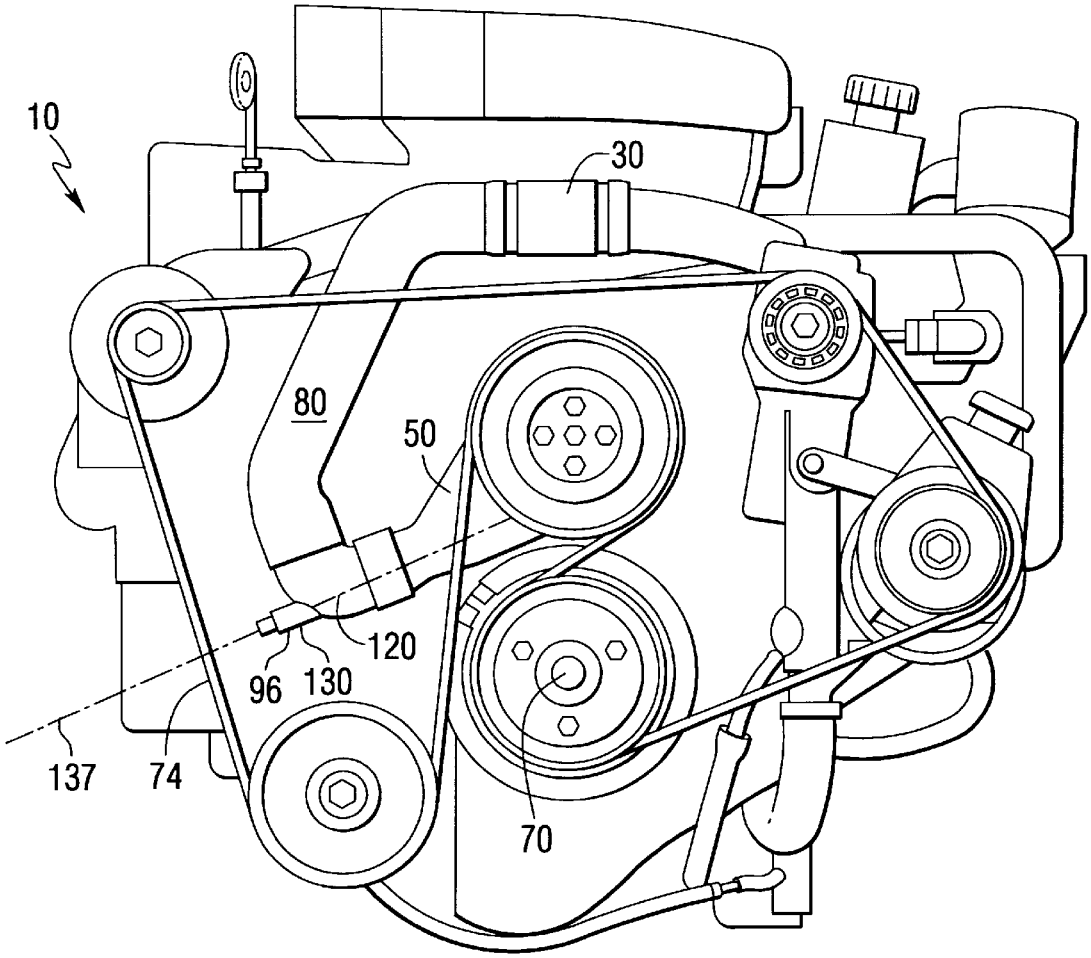
FIG. 11 is a front view of a marine engine with the elbow and connector illustrated in FIGS. 9 and 10.

FIG. 11 shows the elbow insert 120 disposed in fluid communication with the circulating pump hose 80 on an engine 10. With reference to FIGS. 9, 10 and 11 it can be seen that the boss 130 is formed on the elbow insert 120 in such a way so as to align the male member 96 along a line 137 extending through the elbow insert 120 and toward the circulating pump 50. Although not a requirement in all embodiments of the present invention, this particular alignment has been found to be advantageous for two reasons. First, water can be directed by the first check valve 96, or male connector, directly toward the openings within the circulating pump 50. This facilitates the passage of water along a desirable path through the engine. Secondly, it facilitates the attachment of the female member 93 to the male member 96 when the operator of the marine vessel desires to flush the engine 10.

Figure 12:
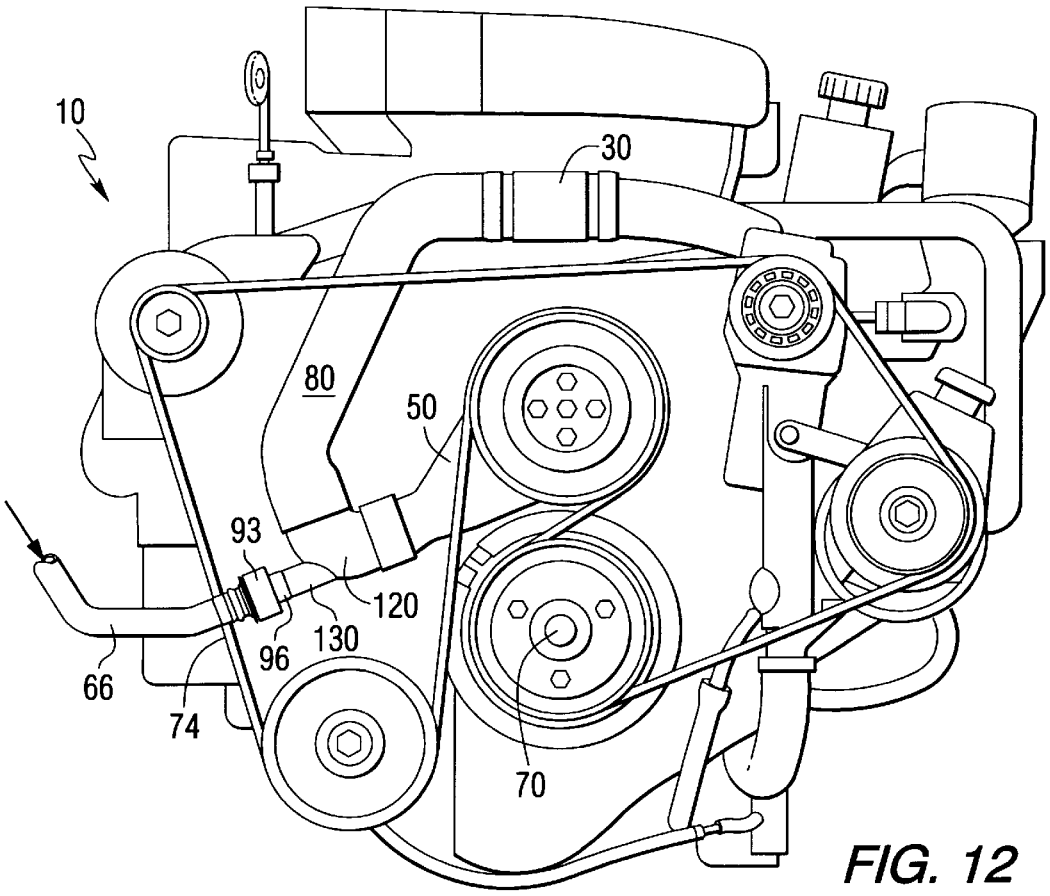
FIG. 12 shows a front view of the engine of FIG. 11 with a hose and additional connector attached to the connector and elbow insert of the present invention.

FIG. 12 shows the engine of FIG. 11, but with a hose 66 attached to the insert elbow 120 through the locking attachment of the male and female components, 96 and 93, described above in conjunction with FIGS. 7 and 8. If fresh water is directed from an external source, in the direction represented by the arrow in FIG. 12, it will pass through the hose 66, through the female check valve connector 93, through the male check valve connector 96, through the boss 130 and into the insert elbow 120. The water will then flow toward and through the circulating pump 50.

With reference to FIGS. 2 and 11, the fresh water will flow from the external source 200, such as an available water faucet, through the hose 66 and through the female connector check valve 93. It should be understood that the check valve 93 shown in FIG. 2 represents the female connector 93 shown in FIG. 7. It is identified as check valve 93 in FIG. 2 because of the action of the moveable members 100 which operates as a check valve in both the female connector 93 and the male connector 96. If the male and female connectors, 96 and 93, are associated in locking attachment together, the fresh water will flow from the female check valve 93 through the male check valve 96 and into the circulating pump hose 80. Although FIG. 2 is highly schematic in nature, it should be understood that the arrow identified by reference numeral 80 in FIG. 2 represents the circulating pump hose 80 described above in conjunction with FIGS. 9 and 10 and the connection between check valve 96 and the circulating pump hose 80 occurs at the elbow insert 120 described above. The water passing through the hose 66 and the check valves, 93 and 96, is generally at a pressure of about 15 psi to 75 psi. This water, after passing through the connecting elbow insert 120, will flow through the circulating pump 50, through the engine block 42, through the heads, 44 and 46, through the intake manifold 40, and into the thermostat housing 30. The fresh water provided by the external source 200 then flows out of the exhaust manifolds, 22 and 23, and the exhaust elbows, 24 and 25, and out of the engine. Some of the fresh water flowing through the thermostat housing 30 also flows back out through the seawater pump 32.

It should be understood that different types of drive units 14 have different types of internal structures. Therefore, the quantity of fresh water flowing through the drive unit 14 may vary as a result of the internal structure of the unit. However, since the primary concern regarding damage caused by seawater residue is the engine block 42, heads, exhaust manifolds, elbows, and intake manifold 40, it is most important that the fresh water be directed through the engine block to clean these internal passages.

Empirical tests have been performed to determine the degree of flushing that occurs when the present invention is used. By introducing fresh water at the elbow insert 120, it has been determined that the internal passages and surfaces of the engine are thoroughly washed clean and all internal compartments of the engine are adequately flushed.

With reference to FIGS. 2 and 12, it can be seen that the present invention provides a significant advantage to boat owners and operators. When it is necessary to flush a marine engine and drive unit, the present invention provides a simple and effective way to accomplish the task without the need to run the engine or removing the boat from the water. A hose 66 is first connected to an external source of fresh water 200. Then, a connector such as the female connector 93 illustrated in FIG. 7 is attached to the end of the hose 66. The external fresh water source 200 can then be turned on. It is anticipated that the fresh water source 200 will typically be a faucet or an outlet from a water pump. Since the female connector 93 has a check valve structure within it, the moveable object 100 will block the flow of water through the check valve 93 until it is appropriately attached to a male connector 96. This allows the operator to activate the fresh water source 200 at a faucet prior to making the connection to the male connector 96 which is attached to the elbow insert 120. The end of the hose 66 can then be carried to the boat where the connection is then made. Meanwhile, the check valve structure within the male connector 96, which is attached to the elbow insert 120, inhibits water from flowing out of the engine 10 whenever check valve 93 is not attached to check valve 96. When the proper connection is made and the two check valves are associated in locking attachment with each other, the moveable members 100 are pushed against their respective springs 102 so that their passages 104 are opened. The water from the hose 66, which is under pressure from the external source 200, then begins to flow along the path illustrated in FIG. 2. It flows through the check valves, 93 and 96, the circulating pump 50, the engine block 42, the port and starboard heads, 44 and 46, the intake manifold 40, the thermostat housing 30 and through the exhaust manifolds and elbows. The fresh water passing through the engine compartments flushes the internal passages of the engine to remove the residue from seawater which was used to cool the engine during normal operation. In another embodiment of the present invention, a male/male adapter can be provided at the elbow and a short hose can be used to connect it to a female garden hose receptacle which is remotely mounted. This permits easier access when the boat operator wishes to connect a garden hose to the flushing system.

When the flushing operation is complete, the female connector 93 attached to the hose 66 is removed from the male connector 96 attached to the elbow insert 120. This disconnection causes both moveable members 100 to seal their respective components and prevent water from flowing through paths 104. The hose 66 can then be returned to the external source of water 200 and disconnected.

The procedure described immediately above is a significant improvement over known methods of flushing engines. Most procedures that are known to those skilled in the art require complex equipment and a much greater effort than that described above in conjunction with the present invention.

The primary advantages of the present invention are that it is simple in structure, relatively inexpensive, and highly effective. These advantages are the result of the advantageous use of the elbow insert 120 and the particular location where the elbow insert is placed in conjunction with the circulating pump hose 80. Additional advantage is achieved by the positioning and alignment of the boss 130 so that the male connector 96 directs the stream of water toward the circulating pump 50. All of these characteristics combine to provide a device for flushing an engine which is relatively inexpensive, simple to use, and highly effective in flushing the engine. Although the present invention has been described with particular detail and illustrated to show specific advantages of a particular preferred embodiment, it should be understood that other embodiments are also within its scope.

We claim:

1. An engine flushing system, comprising:

a conduit connected in fluid communication with a circulating pump of said engine; and a first check valve connected in fluid communication with said conduit, said first check valve being configured to prevent water from flowing through said first check valve unless said first check valve is opened by a first external means, said check valve being connectable in fluid communication with an external water supply, said conduit being connected between said circulating pump and a thermostat housing.

2. The flushing system of claim 1, further comprising:

a second check valve attached to a hose of said external water supply, said first and second check valves being shaped to receive each other in locking attachment, said locking attachment permitting water flow through said first and second check valves.

3. The flushing system of claim 2, wherein:

said second check valve is configured to prevent water from flowing from said external water supply through said second check valve unless said second check valve is opened by a second external means.

4. The flushing system of claim 3, wherein:

said first check valve is said second external means.

5. The flushing system of claim 2, wherein:

said first check valve is shaped to fit into said second check valve to accomplish said locking attachment.

6. The flushing system of claim 1, wherein:

said engine is a marine engine.

7. The flushing system of claim 1, further comprising:

an elbow insert connected in fluid communication with said conduit, said first check valve being attached to said elbow insert to permit water to flow through a wall of said elbow insert.

8. The flushing system of claim 1, wherein:

said first check valve is aligned to cause water flowing through said first check valve to flow directly toward said circulating pump.

9. A marine engine flushing system, comprising:

a conduit connected in fluid communication with a circulating pump of said engine;

a first check valve connected in fluid communication with said conduit, said first check valve being configured to prevent water from flowing through said first check valve unless said first check valve is opened by a first external means, said check valve being connectable in fluid communication with an external water supply; and a second check valve attached to a hose of said external water supply, said first and second check valves being shaped to receive each other in locking attachment, said locking attachment permitting water flow through said first and second check valves, said second check valve being configured to prevent water from flowing from said external water supply through said second check valve unless said second check valve is opened by a second external means, said first check valve being said second external means.

10. The flushing system of claim 9, further comprising:

an elbow insert connected in fluid communication with said conduit, said first check valve being attached to said elbow insert to permit water to flow through a wall of said elbow insert.

11. The flushing system of claim 10, wherein:

said conduit is connected between said circulating pump and a thermostat housing.

12. The flushing system of claim 11, wherein:

said first check valve is aligned to cause water flowing through said first check valve to flow directly toward said circulating pump.

13. The flushing system of claim 12, wherein:

said first check valve is shaped to fit into said second check valve to accomplish said locking attachment.

14. The flushing system of claim 9, further comprising:

an elbow insert connected in fluid communication with said conduit, said first check valve being attached to said elbow insert to permit water to flow through a wall of said elbow insert.

15. A marine engine flushing system, comprising:

a conduit connected in fluid communication with a circulating pump of said engine;

a first check valve connected in fluid communication with said conduit, said first check valve being configured to prevent water from flowing through said first check valve unless said first check valve is opened by a first external means, said check valve being connectable in fluid communication with an external water supply; and a second check valve attached to a hose of said external water supply, said first and second check valves being shaped to receive each other in locking attachment, said locking attachment permitting water flow through said first and second check valves, said second check valve being configured to prevent water from flowing from said external water supply through said second check valve unless said second check valve is opened by a second external means, said first check valve being said second external means, said conduit being connected between said circulating pump and a thermostat housing, said first check valve being aligned to cause water flowing through said first check valve to flow directly toward said circulating pump, said first check valve being shaped to fit into said second check valve to accomplish said locking attachment.

* * * * *